United States Patent [19]

Mori et al.

[11] Patent Number: 4,738,003

[45] Date of Patent: Apr. 19, 1988

[54] DOOR OPENING/CLOSING HINGE DEVICE

[75] Inventors: Keiji Mori, Kariya; Nozomu Torii, Hekinan; Ryoichi Fukumoto, Nagoya, all of Japan

[73] Assignee: Aisin Seiki Kabushiki Kaisha, Aichi, Japan

[21] Appl. No.: 864,519

[22] Filed: May 19, 1986

[30] Foreign Application Priority Data

May 17, 1985 [JP] Japan ..... 60-103861
May 17, 1985 [JP] Japan ..... 60-103862

[51] Int. Cl.[4] ..... E05D 11/10

[52] U.S. Cl. ..... 16/321; 16/357; 16/368; 16/370

[58] Field of Search ..... 16/357, 358, 360, 308, 16/368, 366, 370, 378, 369, 287, 288, 323, 334, 321; 296/146, 202, 76; 49/248

[56] References Cited

U.S. PATENT DOCUMENTS 683,887 10/1901 Bedell ..... 16/288
3,758,990 9/1973 Balanos ..... 16/370
4,294,039 10/1981 Dalheimer et al. ..... 296/76

FOREIGN PATENT DOCUMENTS 58-36766 3/1983 Japan .
58-36765 8/1983 Japan .
58-36767 8/1983 Japan .
58-36768 8/1983 Japan .

*Primary Examiner*—Nicholas P. Godici
*Assistant Examiner*—G. M. Reid
*Attorney, Agent, or Firm*—Burns, Doane, Swecker & Mathis

[57] ABSTRACT

A vehicle door opening/closing hinge device comprises an outer link having one end connected to a first pillar pin and the other end connected to a first door pin, an inner link disposed longitudinally apart from the outer link and having one end connected to a second pillar pin, and a connecting link having one end connected to the other end of the inner link and the other end connected to a second door pin, so as to form a five joint link mechanism. The inner link is formed with a guide member having a slot engageable with a third door pin to control door opening positions. In the above door hinge device, since an angle subtended by the inner link and the connecting link is small at the door full closed position, it is possible to increase the thickness of the vehicle pillar for providing a more rigid pillar, widen the passenger getting in-or-out space at passenger's feet at the initial door open position, and smoothly and widely open the door to the door full open position for providing a wider passenger's space.

19 Claims, 10 Drawing Sheets

DOOR OPENING/CLOSING HINGE DEVICE

BACKGROUND OF THE INVENTION

1. Field of the Invention

The present invention relates to a door opening/closing hinge device which can provide a wide passenger space (a space through which passengers get in or out of an automotive vehicle), in particular, immediately after a door of an automotive vehicle has been opened, on the basis of a link mechanism.

2. Description of the Prior Art

Japanese Utility Model Kokoku-publication No. 58-36766 discloses a door hinge device for automatic vehicles of this type as shown in FIG. 1. In the drawing, the reference numeral 1 denotes a bracket fixed to a vehicle body pillar and 5 denotes another bracket fixed to a vehicle door. The former bracket 1 and links 2, 3 and 4 are pivotably connected to each other by pins 22, 32, 42 and 43 so as to form a parallel link mechanism. Further, the latter bracket 5 is pivotably connected to the links 3 and 4 by a connecting pin 43. The bracket 5 is provided with a fixed guide pin 55 slidably connected to a slot 25 formed of an extension end of the link 2.

In this door hinge for an automotive vehicle, when a door A is moved in the door opening direction, the pin 43 of the bracket 5 is moved to a position 43' along a circular arc with the link 3 as its radius, and additionally the link 2 connected to the link 4 by the pin 42 is also moved together, so that the parallel link mechanism is pivoted counterclockwise. In this movement, the bracket 5 is provoted together about the pin 43 on the basis of the connection relationship between the guide slot 25 and the guide pin 55.

In dependence upon the above operation, the door A is initially swung open in the frontward and outward directions according to the curve of the slot 25 to a half open position A' while keeping the passenger getting in-and-out space wide at passenger's feet. When being further opened, the door A is pivoted about the pin 43' to the full open position A".

SUMMARY OF THE DISCLOSURE

In the conventional door hinge device as described above, however, since the parallel link mechanism is such that the link 4 is disposed at an angle of $\alpha$ (about 90 degrees) with respect to the longitudinal axis 2C of the inner link 2 and further the door position is restricted on the basis of the positions of pins 43 and 55, a straight line B connecting the two pins 43 and 55 inclines at an angle of $\beta$ degrees with respect to the longitudinal direction of the vehicle. In the prior-art door hinge device, since this angle $\beta$ is relatively large, there exist drawbacks such that it is necessary to increase a space W2 in the door thickness direction within which the hinge device is disposed between the door and the pillar and therefore the thickness dimension W1 of the pillar is inevitably reduced, so that the rigidness of the pillar is not sufficient because the pillar cross-sectional area is small.

In the door hinge device of this type, it is preferably to dispose the slot for restricting door positions roughly in parallel to the axis B, and further the conditions of the door opening mainly depend upon the length of this slot. In the prior-art door hinge device, however, since the axis B inclines at a relatively large angle $\beta$, in the case where the full open degree of the door is intended to be large the slot extends toward the passenger compartment, so that a more space in the thickness direction is required. Therefore, these exists another problem in that it is impossible to sufficiently swing the door in the outward direction. In addition, since the prior-art door hinge device is so constructed that the locus of the door end point A2 depicts a curve a and further the door opening/closing direction changes markedly at the half open position a', there exists another problem such that the door opening/closing motion is not smooth and the feeling of the door operation is not comfortable.

The present invention has been proposed to eliminate the above-mentioned drawbacks. An object of the present invention is to provide a door hinge opening/closing device which can provide a wide passenger getting in-or-out space at passenger's feet and further a wide door opening angle without increasing the space in the thickness direction within which the hinge device is housed between the door and the pillar.

To achieve the above-mentioned object, the present invention provides:

a door opening/closing hinge device for a vehicle including an outer link, an inner link and a connecting link, wherein:

(a) said outer link extends in a vehicle longitudinal direction on an outside of a door thickness space, a first end thereof being pivotably supported by a first vehicle pillar-side pin and a second end thereof being pivotably supported by a first door-side connecting pin;

(b) said inner link is disposed in the door thickness space at a position determined by shifting said outer link in an obliquely inside direction of the vehicle substantially in parallel to said outer link, a first end thereof being pivotably supported by a second vehicle pillar-side pin; and (c) said connecting link is disposed substantially in parallel with said inner link, a first end thereof being pivotably connected to a second end of said inner link by a pin and a second end thereof being pivotably supported at a point between the pin and the second vehicle pillar-side pin by a second door-side connecting pin located inside the first door-side connecting pin and outside said inner link.

According to the first aspect of the present invention, the second door-side connecting pin is disposed to pivotably support the connecting link inside the first door-side connecting pin for pivotably supporting the outer link. Further, the connecting link is pivotably connected to the inner link so as to be substantially in parallel to the inner link in such a way that an angle $\alpha$ subtended by the two links becomes small by folding the two links when the vehicle door is fully closed but increases as the vehicle door is opened. Therefore, it is possible to increase the passenger getting in-or-out space of the door at passenger's feet without excessively increasing the length of the links. Further, since the hinge device can be disposed within an area obtained by a recessed door space in which a door check device is housed in the conventional door and by a door trim, it is possible to securely increase the width W1 in vehicle front pillar cross section.

Further, according to the second aspect of the present invention, in addition to the structure of the first aspect thereof, said door position holding means is provided so as to engage the second end of the inner link with a door-side bracket at a position, when door is open, backward of the second door-side connecting pin in the vehicle longitudinal direction so as to enlarge the angle subtended by a line connecting the door-side bracket engagement position and the second door-side connecting pin and a line parallel with the vehicle longitudinal direction with advance of door opening operation.

Therefore, the rear edge of the door is more widely opened in the vehicle outward direction about the front edge of the door as compared with the front edge thereof and further the opening angle of the door is increased. As a result, it is possible to increase the passenger space of the door through which the passenger can get in or out at passenger's feed when he takes the passenger seat and additionally at passenger's body when he gets out of the vehicle.

Further, according to the second aspect of the present invention, since the second and third door-side connecting pins for controlling the door position are disposed substantially in parallel with the vehicle longitudinal direction, it is possible to dispose the pin for connecting the inner link and the connecting link in the direction perpendicular to the line connecting these second and third door-side connecting pins. As a result, it is possible to continuously and smoothly form the curves of a first slot portion engaged with the third door-side connecting pin so that a smooth door opening/closing curved locus can be obtained. Further, since the first slot portion is formed in parallel with the longitudinal direction of the inner link, it is possible to pivot the outer link to such a position substantially perpendicular to the vehicle longitudinal direction when the door is half open, and therefore the door is pivoted open outward as wide as possible in the door half-open operation along any desired door open locus.

Further, in the second aspect of the present invention, in the case where the door position holding means is so arranged as to provide two-stage connecting means (e.g., comprising two-staged slot portions), it is possible to reduce the door thickness and the door longitudinal dimension. When the door dimension in the longitudinal direction is reduced, in particular, it is possible to house the hinge device in a space between the door inner panel and the trim. A wide passenger space at passenger's feet can be obtained by the first-stage connecting means (e.g., first slot portion) for realizing an initial engagement relationship between the inner link and the door when the door is first opened to raise the outer link outward (door moves away from the vehicle longitudinal direction) and simultaneously to increase the angle $\alpha$. When the door is roughly half open, the first-stage engagement relationship is released. Immediately before this first-stage engagement is released, the second-stage connecting means (e.g., second slot portion) realizes the succeeding engagement relationship. When the door is further pushed open, the outer link further rises, and the door opening angle is increased by this second-stage connecting means. Where the connecting means is formed or divided in two stages as described above, each mutual engagement relationship between the inner link and the door can be changed freely, so that it is possible to more freely control the door open position. A particular embodiment includes a divided connecting means in two stages, i.e., in two slot portions formed in separate members. This embodiment provides a still-more freedom in design.

In the above-mentioned door hinge mechanism of this type, a door check mechanism is generally required to check any given door opening angle positions or to determine door opening/closing operation load. In the present invention, the above check mechanism can be incorporated in the inner link and the connecting link in combination. The check mechanism determines the door opening/closing load in dependence upon a friction force between a roller and a cam surface. Further, these parts are all sealed and disposed on the passenger compartment side, so that it is possible to eliminate a problem such that the sliding load between the roller and the cam surface excessively icnreases due to the influence of change in in-use ambience, for instance, such as adhesion of sand, dust, water or freezing. The above arrangement of the device on the passenger compartment side results in a secondary effect such that the door opening/closing operation force can thus be stabilized.

DETAILED DESCRIPTION OF THE PREFERRED EMBODIMENTS

The embodiments of the present invention will be described hereinbelow with reference to the attached drawings.

Figure 1:
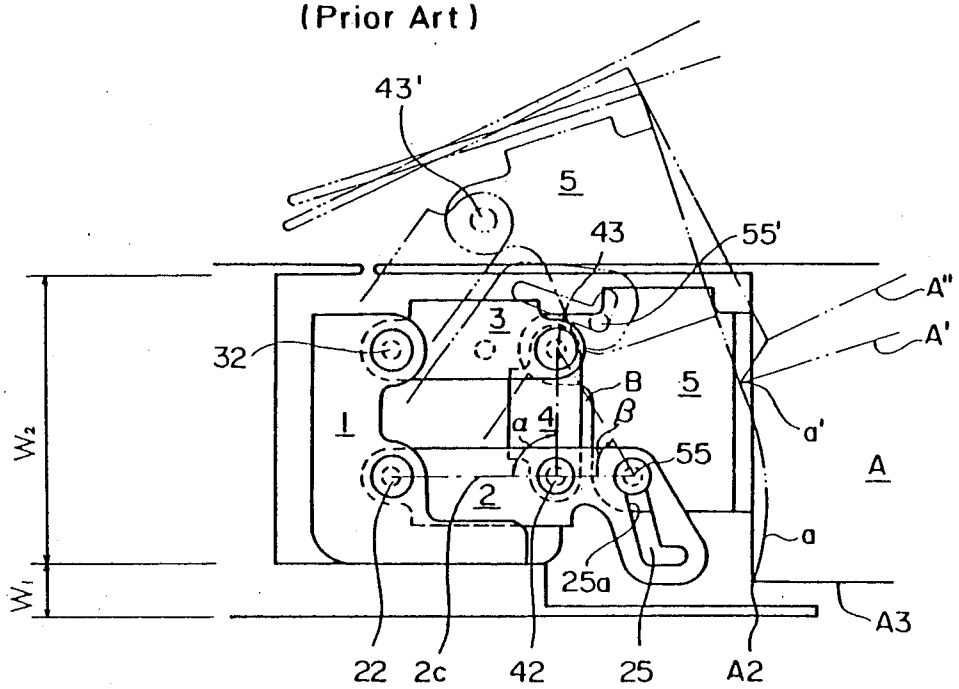
FIG.1 (Prior Art)
FIG. 1 is a top view showing a prior-art door inner link, it is possible to pivot the outer link to such a FIG. 2 is a perspective view showing a first embodiment of the door opening/closing hinge device for automotive vehicles according to the present invention.
Figure 2:
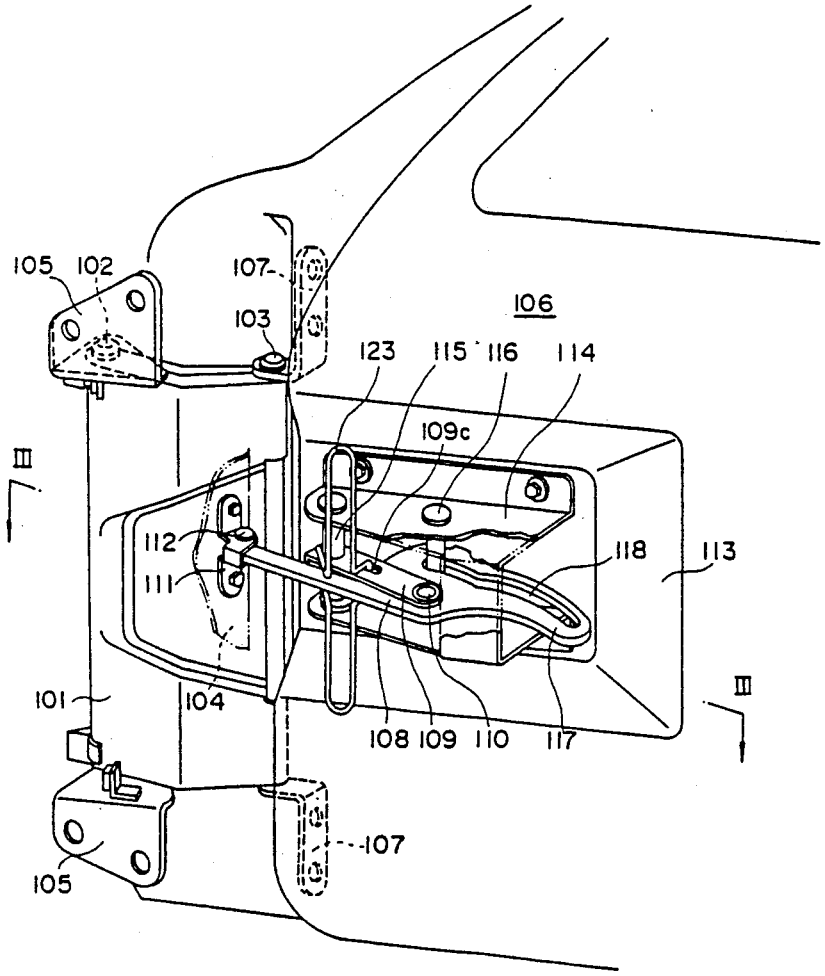

FIG. 2 is a perspective view showing a first embodiment of the present invention, in which the door opening/closing hinge device is seen obliquely in the downward direction from above on the inner side of a door. An outer link 101 is disposed on the outside of a door thickness space and extends in the vehicle longitudinal (front and rear) direction. One end of the outer link is pivotably supported by a pin 102 disposed on the vehicle pillar side, and the other end thereof is pivotably supported by a first door-side conecting pin 103. The vehicle pillar-side in 102 is pivotally supported by two pillar brackets 105, 105 fixed to a pillar 104 (See FIG. 3) with respect to the vertical position of the vehicle. In the same way, the first door-side connecting pins 103 is pivotably supported by two brackets 107, 107 fixed to the door 106 vertically of the vehicle. As shown in FIG.

Figure 4:
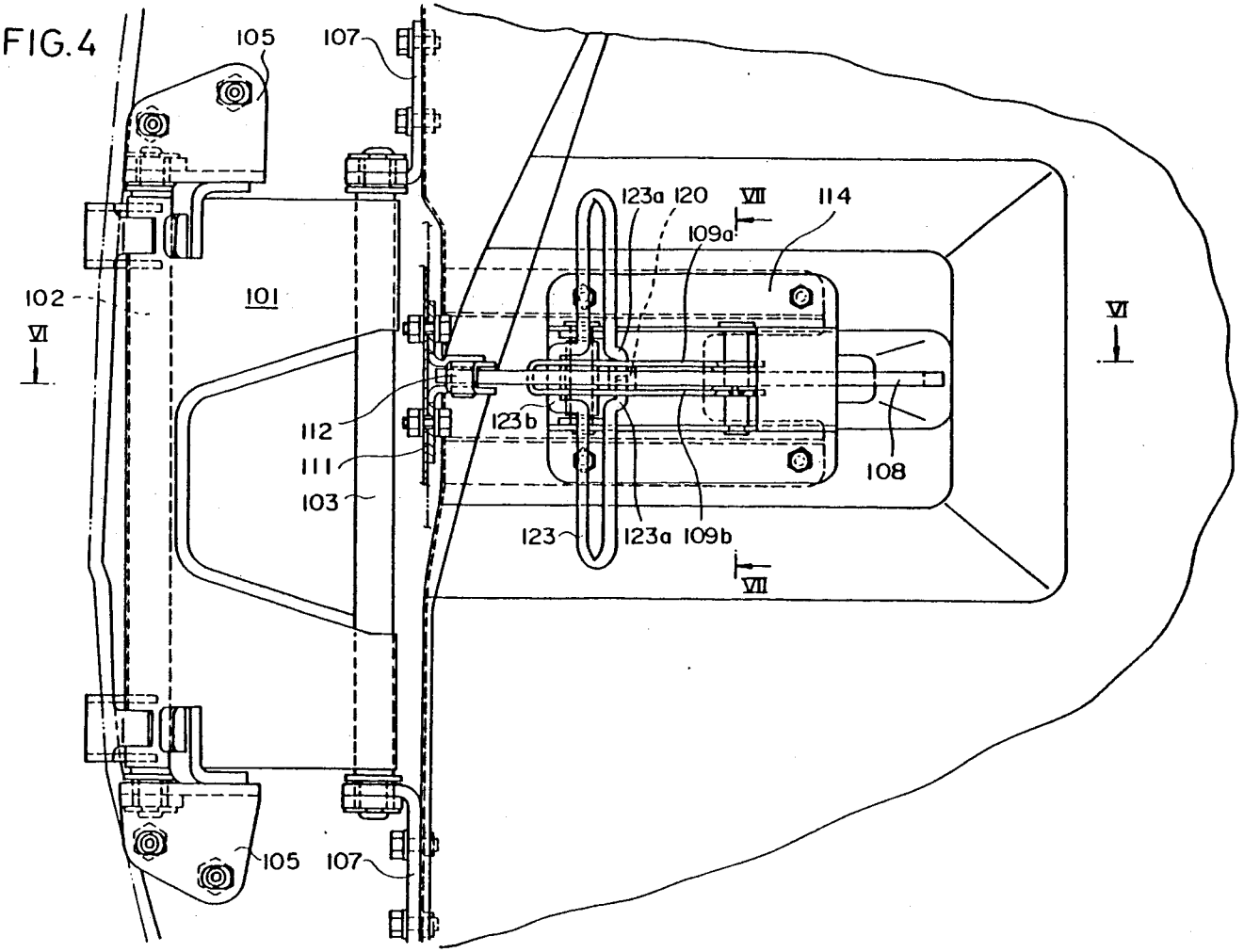
FIG. 4 is an enlarged front view of the device shown in FIG. 2.
Figure 7:
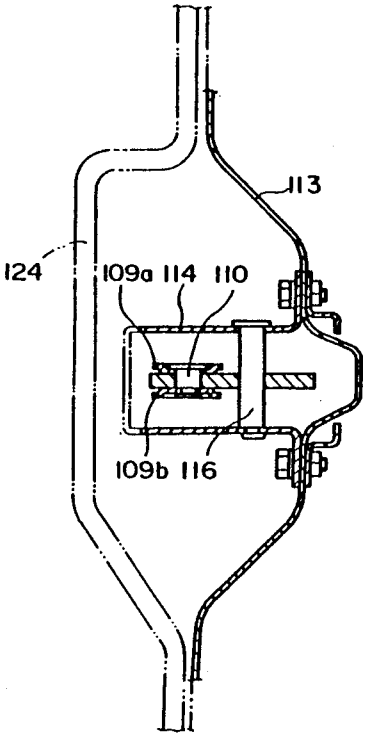
FIG. 7 is a cross-sectional view taken along the line VII—VII shown in FIG. 4.
Figure 6:
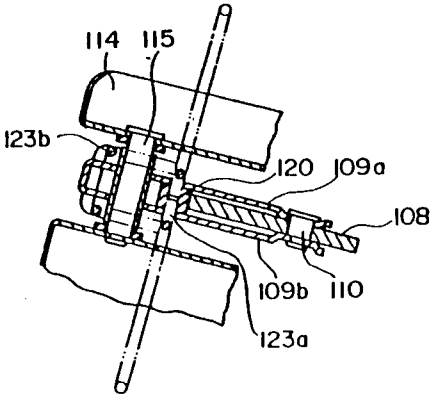
FIG. 6 is a cross-sectional view taken along the line VI—VI shown in FIG. 4.

3, there are disposed an inner link 108 and a connecting link 109 at positions obtained by shifting the outer link 101 in the obliquely inside direction substantially in parallel with the outer link 101. As depicted in FIGS. 4 and 6, the connecting link 109 is formed by bending a piece of plate so as to sandwich the inner link 108 between the inner surfaces of two free end plates 109*a*, 109*b* of the connecting link 109. One end of these two links 108, 109 are pivotably supported by a pin 110. The other end of the inner link 108 is pivotably supported by a pin 112 inserted to a bracket 111 fixed to the pillar 104. The other end of the connecting link 109 is pivotably supported by a second door-side connecting pin 115 passing through a bracket of a U-shaped cross section fixed to an inner panel 113 of the door 106. These links 101, 108, 109, the pillar 104 and the door 106 constitute a five-joint link mechanism in cooperation with pins 102, 103, 110, 112 and 115.

Figure 3:
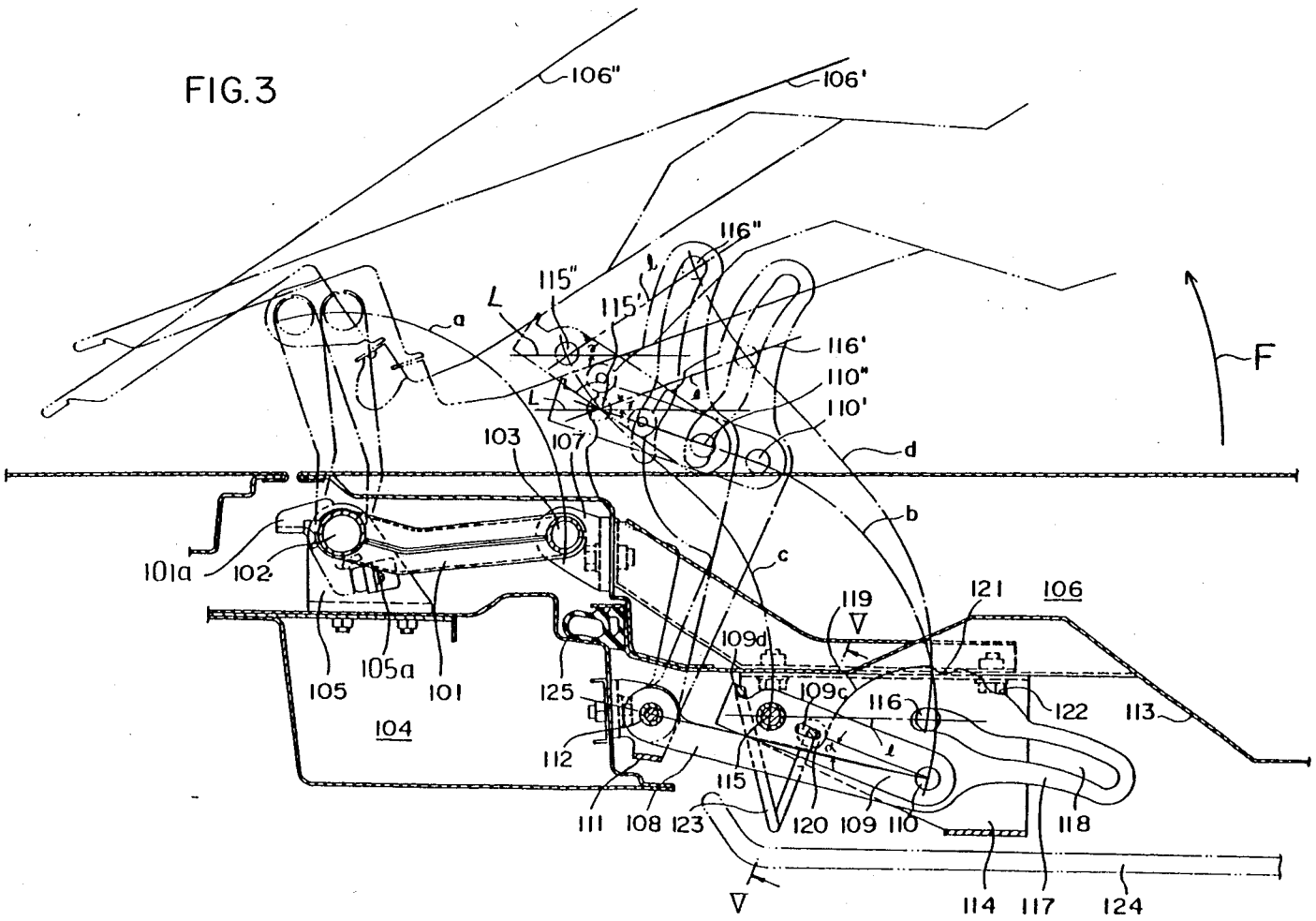
FIG. 3 is an enlarged cross-sectional view taken along the line III—III shown in FIG. 1.

In the above-mentioned U-shaped cross-section bracket 114 fixed to the inner panel 113, a third door-side connecting pin 116 is pivotably mounted on and crossing the bracket in the vertical direction. This third door-side connecting pin 116 is used for controllably restricting the opening/closing position of the door 106 in cooperation with a guide member 117 formed as an extension of the inner link 108, and arranged near a pin 110 connecting the inner link 108 and the connecting link 109. It is preferable that the third door-side connecting pin 116 is located on the outer side of the pin 110 in the direction of the door thickness. As shown in FIG. 3, the guide member 117 is formed with a slot 118 for restricting the movement of the third door-side connecting pin 116, and extends in the vehicle longitudinal direction together with this slot 118. The third door-side connecting pin 116 is slidably engaged with this slot 118. The slot 118 is shaped by connecting three circular arcs in contact with each other so as to be roughly straight.

Figure 5:
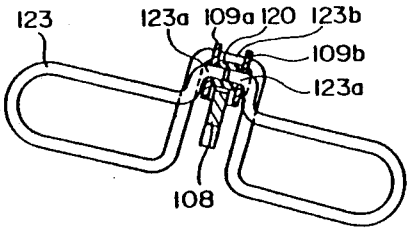
FIG. 5 is a cross-sectional view taken along the line V—V shown in FIG. 3.

At a position other than the slot 118, the guide member 117 has a circular contour. The outer periphery of this circular contour is a cam surface 119 along which two notches 121, 122 are formed to allow the door operator to be sensible of two half-open and full-open positions by the door 106 in cooperation with a roller 120. As depicted in FIGS. 4 to 6, the roller 120 is so arranged as to be rotatable in contact with the cam surface 119 of the inner link 108 between two inner surfaces of the plates 109*a* and 109*b* of the connecting link 109. The axis of this roller 120 is supported by both end portions 123*a* of a check spring 123 passing through a slot 109*c* formed in the plates 109*a*, 109*b* of the connecting link 109. The slot 109*c* is formed in the longitudinal direction of the link so that the roller 120 moves up and down on the cam surface 110 and the notches 121, 122. As shown in FIGS. 2, 4 and 5, the check spring 123 is formed by symmetrically bending a single torsion bar. An engagement portion 123*b* of the check spring 123 positioned in symmetrical relationship with respect to the both end portions 123*a* engages with a recess 109*d* formed in the connecting link 109 near the second door-side connecting pin 115. In order to enhance the spring effect, the check spring 123 is formed with a long vertical bending portion between the both end portions 123*a* and the engagement portion 123*b*. Owing to this check spring 123, the roller 120 is urged toward the cam surface 119 so as to be brought into contact therewith.

The door opening/closing hinge device is covered by a trim arranged at a recess formed in the inner panel 113 of the door 106 on the inner side of the door 106.

Figure 8:
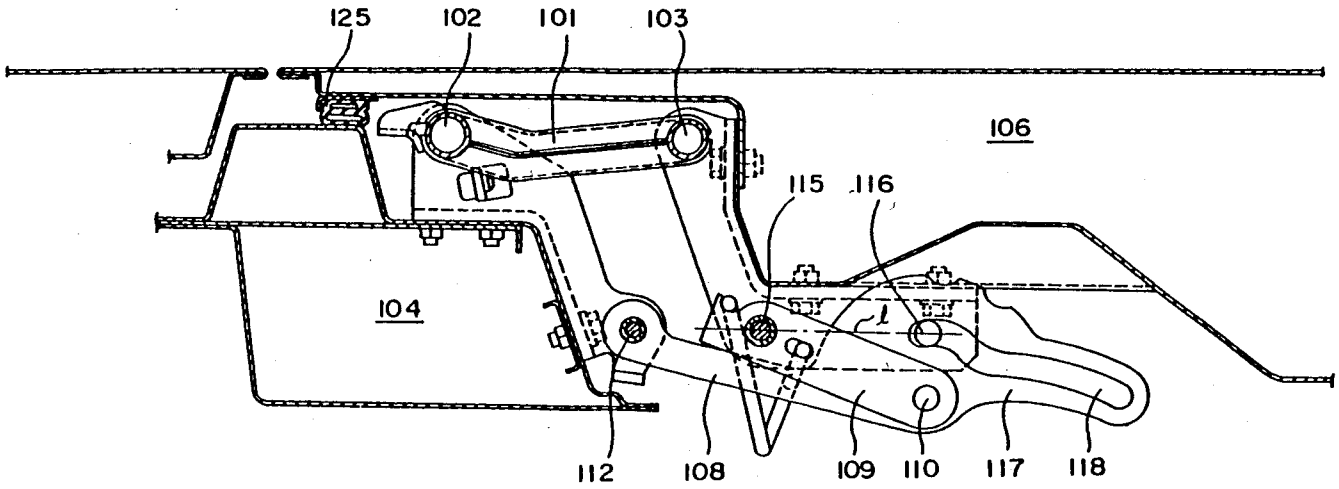
FIG. 8 is a cross-sectional view similar to FIG. 3, in which a seal is disposed at a position different from the shown in FIG. 3.

As shown in FIG. 3, the space between the door 106 and the pillar 104 is covered by a dust-proof seal 125 fixed to the door 106. Although the seal 125 is fixed to the door 106 between the outer link 101 and the inner link 108, it is also possible to fix the seal 125 to the door 106 on the outer side of the outer link so as to be in contact with the pillar 104 when the door 106 is closed, as shown in FIG. 8. In this case, it is also possible to prevent dust from coming into the door opening/closing hinge device.

The operation of the door opening/closing hinge device according to the present invention will be described with reference to FIG. 3. In the drawing, the full-closed position of the door 106 is shown by solid lines and the half-open position 106' and the full-open position 106" are shown by dot-dot-dashed lines. The movement of the door 106 from the full-closed position to the full-open position 106" will be described. As shown in FIG. 3, when a force F is applied to the door 106 in the door opening direction, the outer link 101 is pivoted about the pin 102 as its pivotal center in the counterclockwise direction. At this moment, the first door-side connecting pin 103 goes outward along a circular arc locus a with the outer link 101 as its radius. In dependence open this movement of the outer link 101, it is possible to provide a wide passenger getting in-or-out space at passenger's feet immediately after the door 106 has been opened.

The door position is controlled in accordance with a changeable triangular shape determined by three points of the second door-side connecting pin 115 serving as a pivotal axis of the connecting link 109 connected to the inner link 108, the third door-side connecting pin 116 engaged with the slot 118 formed in the guide member 117 formed as an extension of the inner link 108, and the pin 110 connecting between the inner link 108 and the connecting link 109.

By the force F applied to the door 106 in the door opening direction, the outer link 101 is pivoted about the pivotal axis of the pin 102 on the pillar in the counterclockwise direction, so that the first door-side connecting pin 103 moves along the locus a (See FIG. 3). At the same times, the inner link 108 is also pivoted about the pivoted pin 112 in the counterclockwise direction, so that the pin 110 connected to the connecting link 109 is pivoted along the locus b. At this moment, since the door movement is controllably restricted by the slidable engagement between the third door-side connecting pin 116 and the slot 118 of the guide member 117 formed as an extension of the inner link 108, so that the third door-side connecting pin 116 moves along the locus d. This locus d is so determined as to gradually go away from the locus b as the inner link 108 pivots about the pin 112. Therefore, the connecting link 109 is pivoted about the pin 110 in the clockwise direction to increase the angle $\alpha$ subtended by the inner link 108 and the connecting link 109, so that the second door-side connecting pin 115 moves along the locus c.

Therefore, since the outer link 101 and the inner link 108 both move in the direction perpendicular to the longitudinal direction of the vehicle body as the links are pivoted, the door 106 is pushed outward from the vehicle body. Further, the angle $\gamma$ subtended by a straight line l connecting the second door-side connecting pin 115 and the third door-side connecting pin 116 and the vehicle longitudinal direction L increases in the outward direction of the vehicle because the third connecting pin 116 moves along the slot 118 toward the outer end of the slot, therefore the door 106 is moved in such a way that the rear edge of the door is more widely opened in the vehicle outward direction about the front edge of the door as compared with the front edge thereof, and further the opening angle of the door 106 is increased. As a result, it is possible to increase the passenger space of the door 106 through which the passenger can get in or out at passenger's feed when he takes the passenger seat and additionally at passenger's body when he gets out of the vehicle. During the above operation, when the roller 120 rolles and moves along the cam surface 119 of the inner link 108 up to a half-open condition in which the pins 110, 115 and 116 come to the positions 110', 115' and 116', respectively, the roller 120 drops in the notch 121. In this condition, the door operator can known that the door 106' is half open on the basis of the feeling of engagement between the roller 120 and the notch 121. Further, even in this door half-open condition, the outer link 101 rises away from the vehicle body so as to provide a sufficient passenger space at his feet.

Under these conditions, the slot 118 of the guide member 117 rises substantially perpendicular to the vehicle longitudinal direction. When the door 106' is further opened, the third door-side connecting pin 116' is moved further outward along the slot 118' and therefore the line connecting between the third door-side connecting pin 116' and the second door-side connecting pin 115 further inclines sharply with respect to the vehicle longitudinal direction, so that the open angle of the door 106' increases. During this movement, the roller 120 goes across the first notch 121 and rolls along the cam surface 119. When the third door-side connecting pin 116 reaches the extreme end of the slot 118, the roller 120 engages the second notch 122. The door 106" shown by the dot-dot-dashed lines is full open, at which the door position 106" is determined by three positions 115", 116", and 110" of a triangle formed by three pins 115, 116 and 110 under the conditions that a stopper piece **101*a* of the outer link 101 is brought into contact with a stopper 105*a* of the pillar bracket 105. Further, since the outer link 101 is so determined as to pivot between the door half-open position and the door full-open position, the slot 118 of the guide member 117** corresponding to the door half-open position is formed in a relatively smooth flat configuration.

Figure 9:
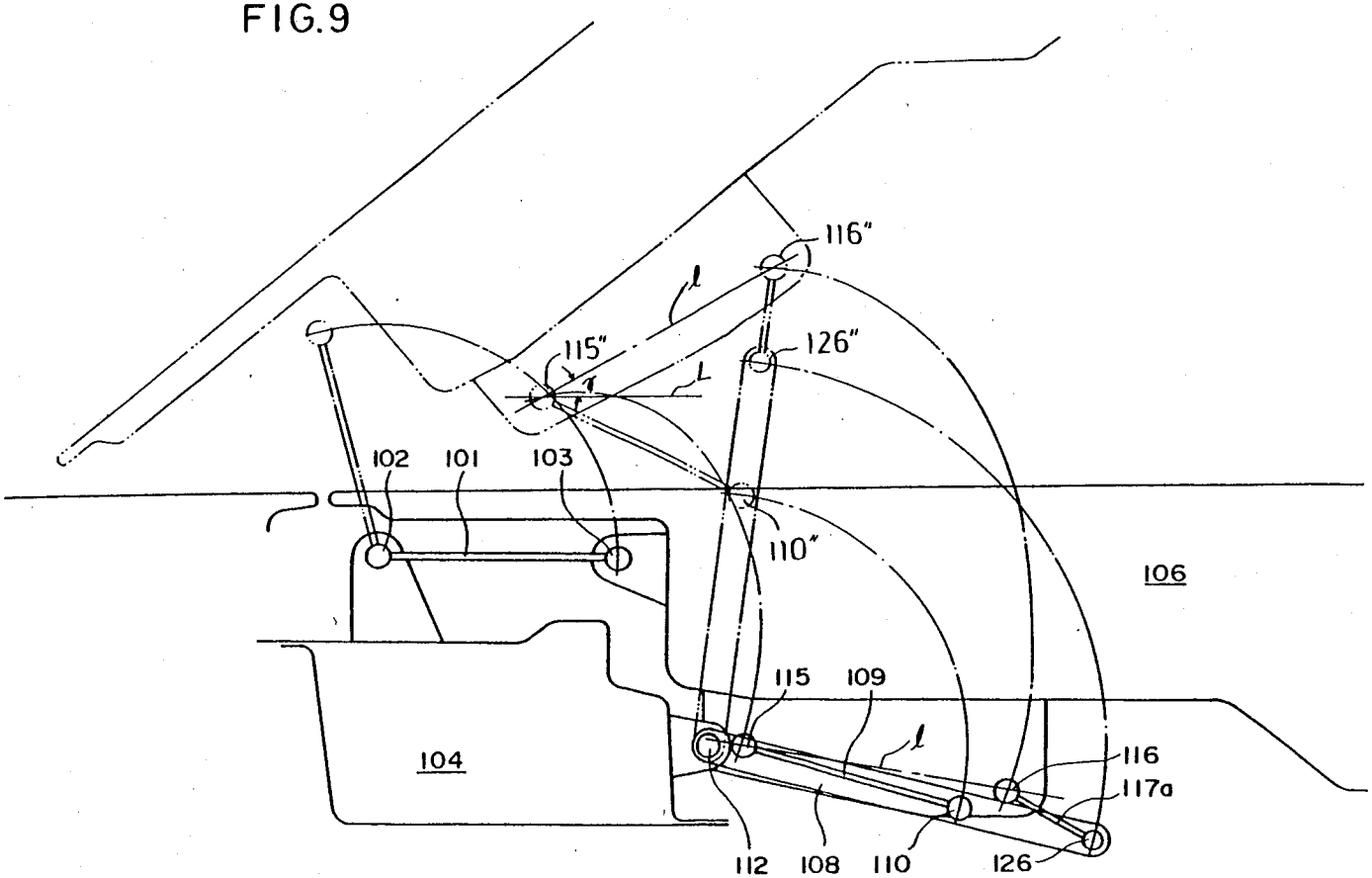
FIG. 9 is a cross-sectional view showing a second embodiment of the door opening/closing hinge device according to the present invention.
Figure 13:
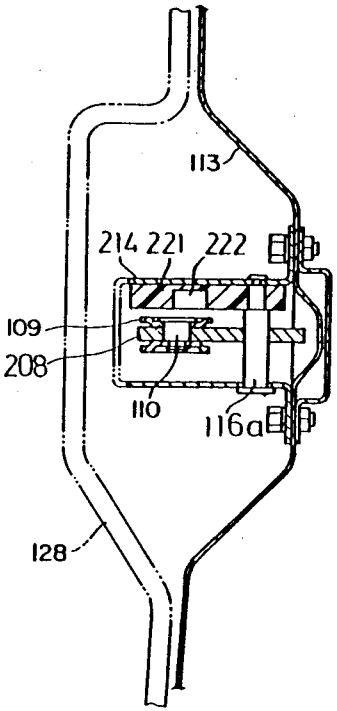
FIG. 13 is a cross-sectional view taken along the line XIII—XIII shown in FIG. 12.

FIG. 9 shows a second embodiment of the present invention. In the first embodiment, the guide member having a slot is provided as an extension of the inner link. In this second embodiment, however, a link is used for the guide member.

In a link **117*a* serving as a guide member, one end of the link 117*a* is pivotably supported by the third door-side connecting pin 116 and the other end thereof is pivotably supported by a pin 126 positioned at an extension of the inner link 108. At the full-open position of the door 106, the link 117*a* is positioned on an extension line of the inner link 108, so that the inclination angle of a straight line connecting between the second door-side connecting pin 115 and a pin 126** increases at its maximum value.

Figure 10:
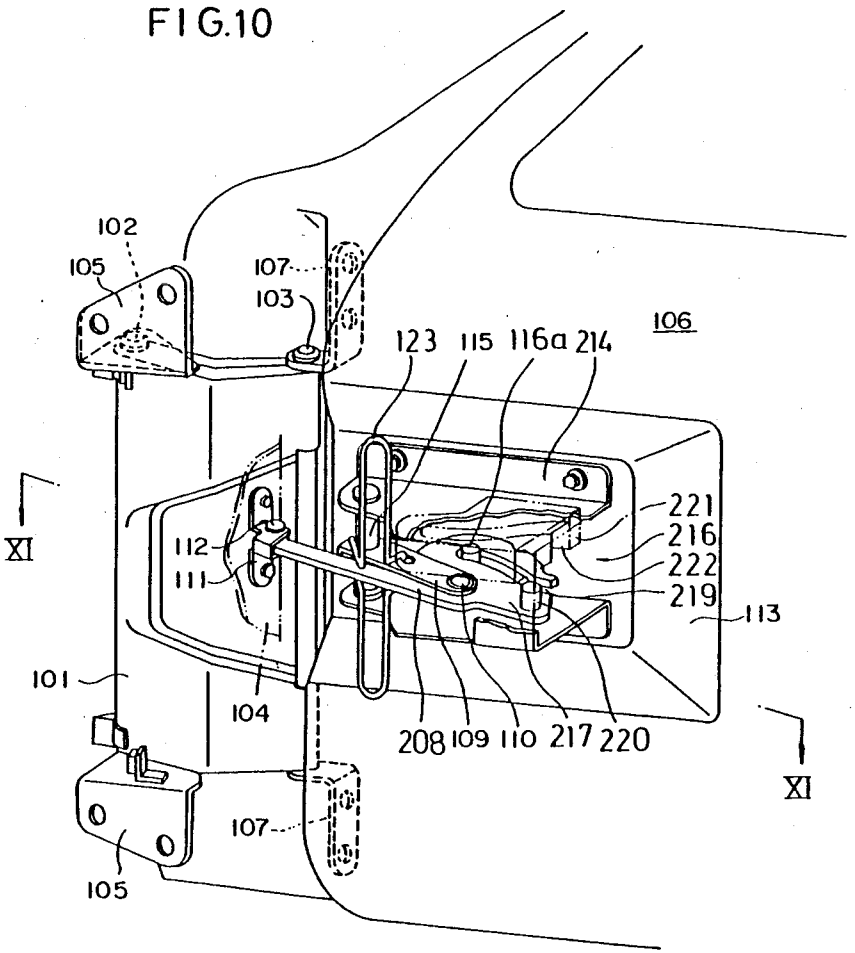
FIG. 10 is a perspective view showing a third embodiment of the door opening/closing hinge device according to the present invention.
Figure 11:
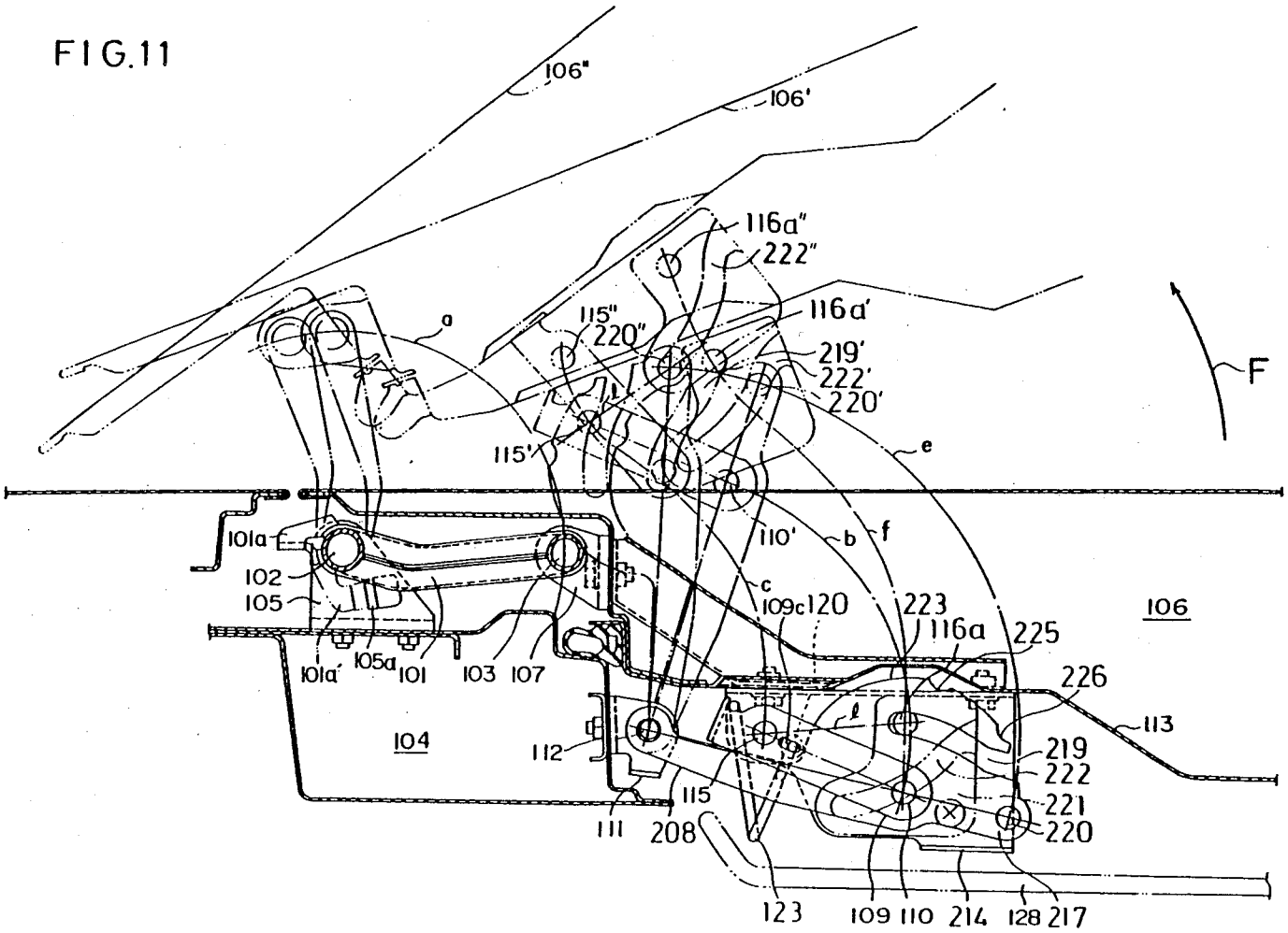
FIG. 11 is an enlarged cross-sectional view taken along the line XI—XI shown in FIG. 10.
Figure 12:
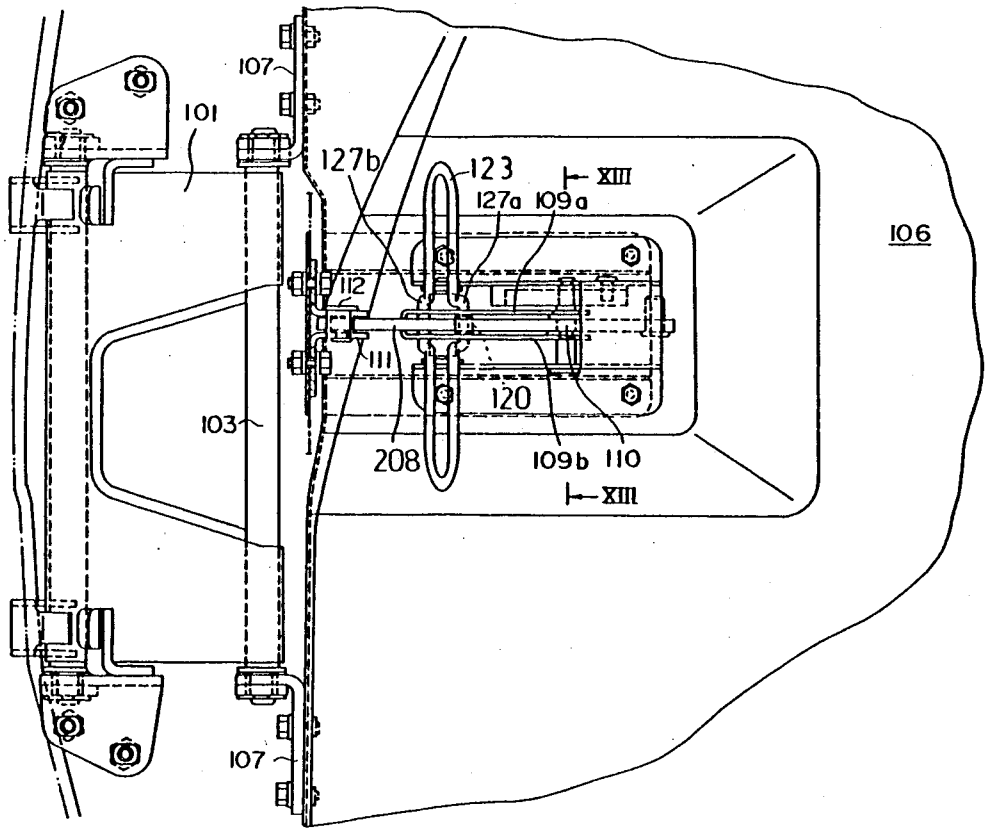
FIG. 12 is an enlarged front view of the device shown in FIG. 10.

FIG. 10 is a perspective view showing a third embodiment of the present invention, in which the door opening/closing hinge device is seen obliquely in the downward direction from above on the inner side of a door. The outer link 101 extends on the outside of the door thickness space in the vehicle longitudinal direction. One end of the outer link 101 is pivotably supported by the vehicle pillar-side pin 102 and the other side thereof is pivotably supported by the first door-side connecting pin 103. The vehicle pillar-side pin 102 is pivotably supported by two pillar brackets 105, 105 fixed to the pillar (See FIG. 11) in the vehicle vertical direction. In the same way, the first door-side connecting pin 103 is also pivotably supported by the brackets 107, 107 fixed to the door 106 in the vehicle vertical direction as in the first embodiment. As shown in FIG. 11, an inner link 208 and a connecting link 109 are disposed at a position obtained by shifting the outer link 101 in the obliquely inside direction roughly in parallel with the outer link 101. As depicted in FIG. 12, the connecting link 109 is formed by bending a piece of plate so as to sandwich the inner link 208 between the inner surfaces of two free end plates **109*a*, 109*b* of the connecting link 109. One end of these two links 208, 109 are pivotably supported by a pin 110. The other end of the inner link 208 is pivotably supported by a pin 112 fitted to the bracket 111 fixed to the pillar 104. The other end of the connecting link 109 is pivotably supported by the second door-side connecting pin 115 passing through a bracket of a U-shaped cross section fixed to an inner panel 113 of the door 106. These links 101, 208, 109, the pillar 104 and the door 106 constitute a five-joint link mechanism in cooperation with pins 102, 103, 110, 112 and 115**.

A door position holding means 216 for restricting the door conditions is so constructed that an extension 217 of the inner link 208 and the above-mentioned bracket 214 of a U-shaped cross section fixed to the inner panel 113 are connected to each other at two separate stages. The first connection stage is an engagement of a third door-side connecting pin **116*a* fixed to the bracket 214 with a first open guide groove 219 (a first slot portion) formed in the extension 217. The first open guide groove 219 opens in the direction of the extension of the inner link 208 roughly in parallel with the inner link 208. The length of this first open guide groove 219 is such an extent that the third door-side connecting pin 116*a* is disengaged therefrom when the door 106 is half open. The third door-side connecting pin 116*a* is fixed to the bracket 214 at such a position as to be located at the bottom end of the first open guide groove 219 when the door 106 is full open. The second connection stage is an engagement of a fixed pin 220 (a fourth connecting pin) fixed to the end of the extension 217 of the inner link 208 with a second open guide groove 222 (a second slot portion) formed in the guide block 221 fixed to the bracket 114. Note that the first and second guide grooves (slot portions) are functionally equivalent to the single slot 118 of the first embodiment as shown in FIG. 3. The second open guide groove 222 opens in the same direction as that of the first open guide groove 219 and extends in the direction that the groove 222 intersects the groove 219. The fixed pin 220 is engaged with this second open groove 222 when the door 106 is half open, and the length of this second open guide groove 222 is such that the fixed pin 220 reaches the bottom of the groove 222 when the door 106 is full open. The fixed pin 220 is fixed to the extension 217 at such a position as to be engageable with the second open guide groove 222 when the door 106** is half open.

As shown in FIG. 11, the extension 217 has a circular contour at a position other than the first open guide groove 219 and remote from the fixed pin 220. The outer periphery of this circular contour is a cam surface 223 along which two notches 225, 226 are formed to allow the operator to be sensible of two half-open and full-open positions of the door 106 in cooperation with the roller 120 which rolles along and on the cam surface 223.

The structures of the roller 120 and the check spring 123 supporting this roller 120 are the same as in the first embodiment shown in FIGS. 5 and 6.

The operation of the above-mentioned door opening/closing hinge device according to the present invention will be described hereinbelow with reference to FIG. 11. In the drawing, the full-closed position of the door 106 is shown by solid lines and the half-open position 106' and the full-open position 106" are shown by dot-dot-dashed lines. The movement of the door 106 from the full-closed position to the full-open position 106" will be described. As shown in FIG. 11, when a force F is applied to the door 106 in the door opening direction, the outer link 101 starts to pivot about the pin 102 as its pivotal center in the counterclockwise direction. At this moment, the first door connecting pin 103 goes outward along a circular locus a with the outer link 101 as its radius. Together with this motion, the inner link 208 pivotes about the second pillar-side pin 112, and the connecting link 109 pivotes about the second door-side pin 115 while spreading the angle $\alpha$ subtended by the inner link 208 and the connecting link 109, so that the second door-side pin 115 moves along the locus c in accordance with the control due to engagement of the third connecting pin **116*a* with the first open guide groove 219. As described above, the door 106 is opened under the restriction and the two loci a and c described by the first and second door-side connecting pins 103, 115, so that it is possible to provide a wide passenger getting in-or-out space at passenger's feet immediately after the door 106** has been opened.

The door position is controlled in accordance with a changeable triangular shape determined by three points of the second door-side connecting pin 115 serving as a pivotal axis of the connecting link 109 connected to the inner link 208 when the door 109 is initially opened, the third door-side connecting pin **116*a* engaged with the first open guide groove 219 formed in the extension 217 of the inner link 208, and the pin 110 connecting between the inner link 208 and the connecting link 109**.

By the force F applied to the door 106 in the door opening direction, the inner link 208 pivots in the counterclockwise direction with the second pillar-side pin 112 as its pivotal center to describe a locus b with the inner link 108 as its radius, so that the changeable triangular shape is determined by the second door-side connecting pin 115, the third door-side connecting pin 116a and the pin 110.

When the inner link 208 pivots in the counterclockwise direction, the third door-side connecting pin 116a located at the bottom of the first open guide groove 219 immediately after the door has been opened moves in the direction of the extension of the inner link 208, so that the line l connecting between the second door-side connecting pin 115 and the third door-side connecting pin **116*a* moves outward. Owing to this operation, it is possible to increase the passenger space at passenger's feet. When the inner link 208 initially located roughly in parallel with the vehicle longitudinal direction moves toward the direction perpendicular to the vehicle longitudinal direction as the outer link 101 is pivoted counterclockwise, the movement of the connecting link 109 is controlled by the pin 110 so that the second door-side connecting pin 115 describes the locus c. Therefore, the third door-side connecting pin 116*a* a constant distance away from this second door-side connecting pin 115 slides along the first open guide groove 219 so as to describes the locus f. The line l connecting the second door-side connecting pin 115 and the third door-side connecting pin 116*a* initially in parallel with the vehicle longitudinal direction L inclines gradually as the inner link rises from the vehicle longitudinal direction, so that the opening angle of the door 106 increases. During this operation, the roller 120 moves along and rolles on the cam surface 223 of the inner link 208. When the three pins 110, 115 and 116*a* constituting a triangle reaches other three positions 110', 115' and 116*a'* at the door half-open positions, the roller 120 drops in the notch 225. At this moment, the door operator can know the door half-open condition on the basis of the feeling of engagement of the roller with the notch. In this door half-open condition, the third door-side connecting pin 116*a'* is completely disengaged from the first open guide groove 219' and subsequently the fixed pin 220 is engaged with the second open guide groove 222'. Further, in this engagement relationship, this fixed pin 220 has already been engaged with the second open guide groove 222' immediately before the third door-side connecting pin 116*a'* is completely disengaged from the first open guide groove 219'**.

When the door 106' is further pushed open outward, the fixed pin 220' slides along the second open guide groove 222' and comes near the bottom of the groove 222'. Therefore, the line connecting between the pin 110' and the second door-side connecting pin 115' whose inclination with respect to the vehicle longitudinal direction is a little increased at the door half-open position further moves toward the direction perpendicular to the vehicle longitudinal direction, so that the opening angle of the door 106' increase as the door reaches the full-open position. When a stopper piece **101*a* of the outer link 101 moves to a point 101*a'* so as to be bought into contact with a stopper 105*a* of the bracket 105 and simultanously the fixed pin 220" reaches the bottom of the second open guide groove 222", the opening rate of the door 106" reaches its maximum. At this moment, the roller 120 moving on the cam surface 223 engages the next notch 226. The door full-open position 106" shown by the dot-dot-dashed lines is obtained on the basis of the triangular positions 112, 115", and 220" constituted by three pins 112, 115, and 220**.

What is claimed is:

1. A door opening/closing hinge device for a vehicle including an outer link, an inner link and a connecting link, wherein:

(a) said outer link extends in a vehicle longitudinal direction on an outside of a door thickness space, a first end thereof being pivotably supported by a first vehicle pillar-side pin and a second end thereof being pivotably supported by a first door-side connecting pin;

(b) said inner link is disposed in the door thickness space at a position determined by shifting said outer link in an obliquely inside direction of the vehicle substantially in parallel at a closed position of the door to said outer link, a first end thereof being pivotably supported by a second vehicle pillar-side pin; and (c) said connecting link is disposed substantially in parallel at a closed position of the door with said inner link, a first end of said connecting link being pivotably connected to a medial portion of said inner link by a pin and a second end thereof being pivotably supported at a point between said medial portion and the second vehicle pillar-side pin by a second door-side connecting pin located inwardly of the first door-side connecting pin and outwardly of said inner link.

2. The door opening/closing hinge device as set forth in claim 1, wherein a sealing member is disposed between the door and the pillar.

3. The door opening/closing hinge device as set forth in claim 1, wherein a position at which the first end of said inner link is pivoted by the second vehicle-pillar side pin is located further backward of the position of the first door-side connecting pin in the vehicle longitudinal direction.

4. A door opening/closing hinge device for a vehicle including an outer link, an inner link, and a connecting link, and a door position holding means, wherein:

(a) said outer link extends in a vehicle longitudinal direction on an outside of a door thickness space, a first end thereof being pivotably supported by a first vehicle pillar-side pin and a second end thereof being pivotably supported by a first door-side connecting pin;

(b) said inner link is disposed in the door thickness space at a position determined by shifting said outer link in an obliquely inside direction of the vehicle substantially in parallel at a closed position of the door to said outer link, one end thereof being pivotably supported by a second vehicle pillar-side pin;

(c) said connecting link is disposed substantially in parallel at a closed position of the door with said inner link, a first end of said connecting link being pivotably connected to a medial portion of said inner link by a pin and a second end thereof being pivotably supported at a position between the pin and the second vehicle pillar-side pin by a second door-side connecting pin located inwardly of the first door-side connecting pin and outwardly of said inner link; and (d) said door position holding means engages the medial portion of said inner link with a door-side bracket at a position, when the door is open, backward of the second door-side connecting pin in the vehicle longitudinal direction so as to enlarge an angel subtended by a line connecting the door-side bracket engagement position and the second door-side connecting pin and a line parallel with the vehicle longitudinal direction during the door opening operation.

5. A door opening/closing hinge device for a vehicle including an outer link, an inner link and a connecting link, wherein:

(a) said outer link extends in a vehicle longitudinal direction on an outside of a door thickness space, a first end thereof being pivotably supported by a first vehicle pillar-side pin and a second end thereof being pivotably supported by a first door-side connecting pin;

(b) said inner link is disposed in the door thickness space at a position determined by shifting said outer link in an obliquely inside direction of the vehicle substantially in parallel at a closed position of the door to said outer link, a first end thereof being pivotably supported by a second vehicle pillar-side pin; and (c) said connecting link is disposed substantially in parallel at a closed position of the door with said inner link, a first end of said connecting link being pivotably connected to a medial portion of said inner link by a pin and a second end thereof being pivotably supported at a point between said medial portion and the second vehicle pillar-side pin by a second door-side connecting pin located inwardly of the first door-side connecting pin and outwardly of said inner link, said inner link being formed with a cam surface, a spring-backed roller rolling on and along said cam surface according to door opening operation being pivotably disposed in association with said connecting link.

6. The door opening/closing hinge device as set forth in claim 5, wherein said roller is urged by a check spring against the cam surface of said inner link, the check spring being anchored against the connecting line.

7. The door opening/closing hinge device as set forth in claim 5, wherein at least one notch is formed in the cam surface so that said roller engages the notch at a predetermined door-open position.

8. The door opening/closing hinge device as set forth in claim 7, wherein two notches are so formed as to correspond to two roller positions established when the door is half open and full open.

9. The door opening/closing hinge device as set forth in claim 6, said check spring comprises a bent torsion bar.

10. A door opening/closing hinge device for a vehicle including an outer link, an inner link, and a connecting link, and a door position holding means, wherein:

(a) said outer link extends in a vehicle longitudinal direction on an outside of a door thickness space, a first end thereof being pivotably supported by a first vehicle pillar-side pin and a second end thereof being pivotably supported by a first door-side connecting pin;

(b) said inner link is disposed in the door thickness space at a position determined by shifting said outer link in an obliquely inside direction of the vehicle substantially in parallel at a closed position of the door to said outer link, one end thereof being pivotably supported by a second vehicle pillar-side pin;

(c) said connecting link is disposed substantially in parallel at a closed position of the door with said inner link, a first end of said connecting link being pivotably connected to a medial portion of said inner link by a pin and a second end thereof being pivotably supported at a position between the pin and the second vehicle pillar-side pin by a second door-side connecting pin located inwardly of the first door-side connecting pin and outwardly of said inner link; and (d) said door position holding means engages the medial portion of said inner link with a door-side bracket at a position, when the door is open, backward of the second door-side connecting pin in the vehicle longitudinal direction so as to enlarge an angle subtended by a line connecting the door-side bracket engagement position and the second door-side connecting pin and a line parallel with the vehicle longitudinal direction during the door opening operation, said door position holding means comprises a third door-side connecting pin connecting said inner link with the door-side bracket and mounted on a door-side bracket at a door close state locating adjacent to the pin connecting said inner link and said connecting link, and a guide member for guiding the third door-side connecting pin substantially toward extension of a longitudinal direction of said inner link while keeping a predetermined positional relationship between the third door-side pin and said inner link.

11. The door opening/closing hinge device as set forth in claim 10, wherein said guide member comprises a first slot formed at the extension of the medial portion of said inner link to which the third door-side connecting pin is slidably engaged.

12. The door opening/closing hinge device as set forth in claim 10, wherein the second and third door-side connecting pins are disposed on a line substantially parallel to the vehicle longitudinal direction.

13. The door opening/closing hinge device as set forth in claim 11, wherein the first slot is formed substantially in parallel to the longitudinal direction of said inner link.

14. The door opening/closing hinge device as set forth in claim 10, wherein said guide member comprises a link having a first end connected to the third door-side connecting pin and a second end pivotably supported on an extension of the second end of said inner link.

15. The door opening/closing hinge device as set forth in claim 13, wherein when the door is being opened, said door position holding means operates in such a manner that the third door-side connecting pin and the first slot portion of the first-stage connecting means are engaged with each other in a first half of the door opening operation and the fourth door-side connecting pin and the second slot portion of the second-stage connecting means are engaged with each other in a second half of the door opening operation.

16. The door opening/closing hinge device as set forth in claim 14, wherein the first slot portion opens in said inner link at an end thereof remote from the vehicle pillar, a length of the first slot portion being such that the first slot portion is disengaged from the third door-side connecting pin when the fourth door-side connecting pin and the second slot portion of the second-stage connecting means are engaged with eath other.

17. A door opening/closing hinge device for a vehicle including an outer link, an inner link, and a connecting link, and a door position holding means, wherein:

(a) said outer link extends in a vehicle longitudinal direction on an outside of a door thickness space, a first end thereof being pivotably supported by a first vehicle pillar-side pin and a second end thereof being pivotably supported by a first door-side connecting pin;

(b) said inner link is disposed in the door thickness space at a position determined by shifting said outer link in an obliquely inside direction of the vehicle substantially in parallel at a closed position of the door to said outer link, one end thereof being pivotably supported by a second vehicle pillar-side pin;

(c) said connecting link is disposed substantially in parallel at a closed position of the door with said inner link, a first end of said connecting link being pivotably connected to a medial portion of said inner link by a pin and a second end thereof being pivotably supported at a position between the pin and the second vehicle pillar-side pin by a second door-side connecting pin located inwardly of the first door-side connecting pin and outwardly of said inner link; and (d) said door position holding means engages the medial portion of said inner link with a door-side bracket at a position, when the door is open, backward of the second door-side connecting pin the vehicle longitudinal direction so as to enlarge an angle subtended by a line connecting the door-side bracket engagement position and the second door-side connecting pin and a line parallel with the vehicle longitudinal direction during the door opening operation, said door position holding means comprises first-stage connecting means including a third door-side connecting pin disposed on a door-side bracket and a first slot portion formed at the medial portion of said inner link substantially along a longitudinal direction of said inner link so that the third door-side connecting pin is slidably engaged thereto, and second-stage connecting means including a fourth door-side connecting pin mounted at the medial portion of said inner link and a second slot portion formed in the door-side bracket so that the fourth door-side connecting pin is slidably engaged thereto.

18. The door opening/closing hinge device as set forth in claim 17, wherein the first slot portion is formed substantially in parallel to a longitudinal direction of said inner link.

19. The door opening/closing hinge device as set forth in claim 17, wherein the second slot portion opens on the same side as in the first slot portion and in such a direction as to intersect the first slot portion.

* * * * *